US007093955B2

(12) United States Patent
Sejkora et al.

(10) Patent No.: US 7,093,955 B2
(45) Date of Patent: Aug. 22, 2006

(54) LIGHT WITH A TRANSPARENT PANEL

(75) Inventors: Günther Sejkora, Schwarzenberg (AT); Markus Bohle, Dornbirn (AT)

(73) Assignee: Zumtobel Staff GmbH, Dornbirn (AT)

( * ) Notice: Subject to any disclaimer, the term of this patent is extended or adjusted under 35 U.S.C. 154(b) by 325 days.

(21) Appl. No.: 10/446,738

(22) Filed: May 29, 2003

(65) Prior Publication Data

US 2004/0012981 A1 Jan. 22, 2004

Related U.S. Application Data

(63) Continuation of application No. PCT/EP01/13753, filed on Nov. 26, 2001.

(30) Foreign Application Priority Data

Nov. 29, 2000 (DE) ..... 100 59 259
Aug. 22, 2001 (DE) ..... 101 41 197
Oct. 30, 2001 (DE) ..... 101 53 380

(51) Int. Cl.
*F21V 9/00* (2006.01)

(52) U.S. Cl. ..... 362/223; 362/222; 362/317

(58) Field of Classification Search ..... 362/217, 362/222, 223, 311, 367
See application file for complete search history.

(56) References Cited

U.S. PATENT DOCUMENTS 1,050,466 A 1/1913 Jones, Jr.
2,258,353 A 10/1941 Doane ..... 240/93
3,117,729 A * 1/1964 Silvers et al.
3,201,582 A 8/1965 Siegel ..... 240/73
3,725,697 A 4/1973 Wince ..... 240/93
3,934,135 A * 1/1976 Szer
4,267,489 A * 5/1981 Morohashi
4,667,275 A * 5/1987 Herst et al.
5,195,818 A 3/1993 Simmons et al. ..... 362/224
5,848,833 A * 12/1998 Margulies et al.
5,988,829 A 11/1999 Holder ..... 362/217

FOREIGN PATENT DOCUMENTS

DE 3907805 A1 9/1990
DE 29602576 U1 5/1996
DE 29906884 U1 9/2000
EP 0490282 A2 6/1992
EP 0490282 A3 6/1992
EP 0911577 A3 4/1999
EP 0911577 A2 4/1999
EP 1028348 A1 8/2000
FR 1470102 2/1967
FR 2098763 3/1972
GB 400029 10/1933
JP 7-141907 6/1995

* cited by examiner

*Primary Examiner*—Laura K. Tso

(57) ABSTRACT

The invention relates to a light comprising a light source or connection means for a light source, and a transparent panel which extends crosswise to a direction of light emission. An object of the invention is to improve the light in terms of glare suppression. To this end, the transparent panel is provided with a microstructure and light homogenization means are provided. The latter ensure that the brightness of the light entering the panel is approximately equal in all parts of the panel.

20 Claims, 4 Drawing Sheets

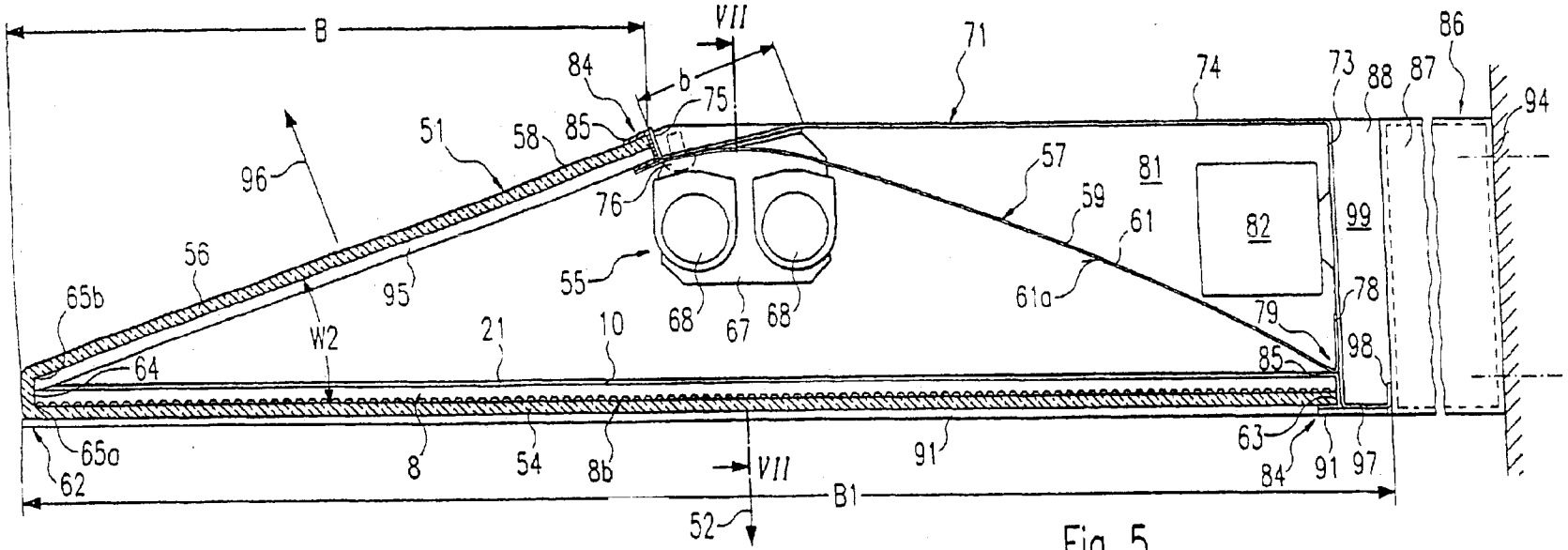
Fig. 5
Fig. 7
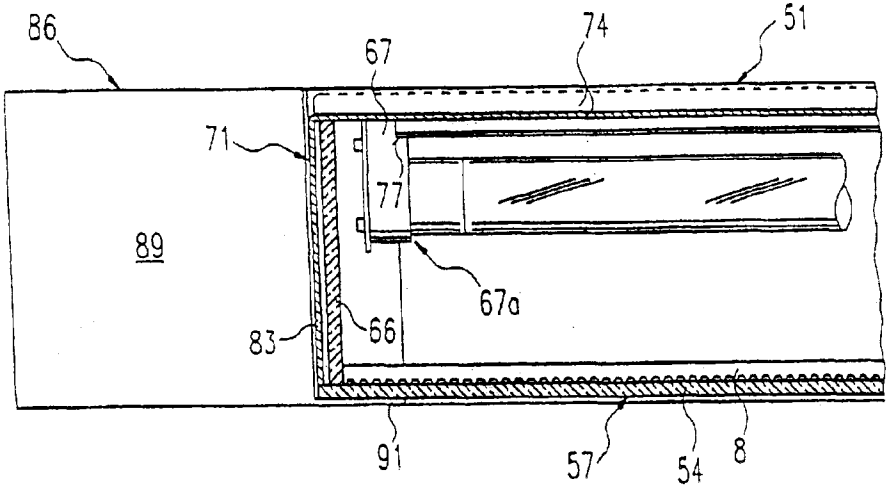

LIGHT WITH A TRANSPARENT PANEL

CROSS REFERENCE TO RELATED APPLICATIONS

This is a Continuation of International Application PCT/EP01/13753 filed Nov. 26, 2001 which in turn claims priority of German Application Nos. DE 100 59 259.7 filed Nov. 29, 2000, DE 101 53 380.2 filed Oct. 30, 2001 and DE 101 41 197.9 filed Aug. 22, 2001, the priorities of which are hereby claimed, said International Application having been published in German, but not in English, as WO 02/44612 A2 on Jun. 6, 2002. The disclosure of that International Application PCT/EP01/13753 is hereby incorporated by reference in its entirety, as if fully set forth herein.

BACKGROUND OF THE INVENTION

1. Field of the Invention

The present invention relates to a light comprising a light source or connection means for a light source, and a transparent panel which extends crosswise to the direction of emission.

2. Description of the Related Art

A light of this type belongs to a known lighting technology principle and is described for example in DE 299 06 884 U. Essential parts of such a light are at least one receptacle for at least one light source that generates the light required to illuminate a space (room), a transparent panel that is arranged between the receptacle and the space to be illuminated and whose outer surface facing the space forms an emission surface, and a base member on which the light source or connection means therefor and the panel are secured.

With known lights of the above type the panel of the light is arranged so that it is enclosed by the base member. The panel in many cases is secured to the base member in such a way that it rests against an inner arm of the base member extending roughly parallel to the panel.

With built-in lights an edge strip in the form of an outer arm may optionally in addition project outwardly from the base member roughly parallel to the panel, which serves to cover the installation gap of an installation opening so that the installation gap is not visible from the surrounding space.

In these modifications the base member comprises edge strips that are visible from the space to be illuminated, which strips are arranged in the case of a light of a lighting fascia on at least two oppositely facing sides of the light, and in the case of an individual light are arranged over the whole perimeter of the light and are visible as dark regions especially when the light is on.

A light panel is described in DE 296 02 576 U1 that is inserted into a ceiling covering and has a flat dome-shaped reflector, a light source arranged therein and a glass panel whose width corresponds to the width of the reflector and that rests on flat edge sections of the reflector. The panel and the reflector, which in their edge regions are thus superimposed on one another in a sandwich-like arrangement, are secured to the underneath of a holding frame that is in turn secured to the existing ceiling.

During operation of an installed light a light pattern produced by the luminous radiation that is of varying brightness and/or variously bright lit surfaces is/are generated at the emission surface of the panel, which are caused by the light source appearing as a surface or profile and by its environment or the reflecting surface. On the one hand this is attributed to the fact that the light intensity of the light emitted at the emission surface of the panel is greater in the immediate region of the light source than adjacent to the light source, which as a rule is arranged in the central region of the panel, i.e. in the lateral regions of the emission surface. Secondly, this is attributed to the fact that the distance between the light source and the panel increases in the lateral regions of the panel and the light is incident at smaller angles on the panel and has to illuminate a larger surface.

In order to homogenize the light pattern it is already known to provide a diffuse or opal panel. Although differences in the light panel and differences in the brightness caused for example by the structure of the light source are reduced, nevertheless in practice the light is undirected, with the result that a certain amount of glare occurs. The latter in any case interferes if the light is observed at a low angle from the side.

SUMMARY OF THE INVENTION

The object of the invention is to improve a light in terms of glare suppression. The invention also aims to avoid or at least reduce differences in the light pattern, for example recognizable structures of the light source, and differences in the brightness of the light pattern.

This object is achieved by a light constructed in accordance with the present invention.

Lights with panels having a microstructure have only recently been introduced into the market. In these lights the light shines laterally or from a narrow side onto the panel, and the light exits broadside at the microstructure of the panel in a substantially glare-free manner.

The invention is based on the knowledge that this effect is also utilizable and advantageous for a generic light according to the invention. In the modifications according to the invention light from the at least one light source passes transversely through the panel comprising the microstructure, the light rays being emitted at the emission surface without any significant glare. In order to avoid or at least to reduce variously bright regions of the light pattern recognizable at the emission surface during operation of the light and caused for example by the light source itself, it is advantageous to provide the transparent panel not only with a microstructure, but also with light homogenization means that ensure that the amount of light or intensity of the light entering the panel is approximately equal in all parts of the panel. In this way variously bright regions and structures in the light pattern recognizable at the emission surface of the light during operation are avoided or at least reduced.

Several modifications that in each case individually and also in combination achieve the object are proposed according to the invention. The light homogenization means may thus be formed by various measures, which may be used alternatively or in combination.

A first possibility consists in the use of a film having a scattering effect, which can be arranged directly on the inside of the panel or spaced therefrom. The scattering effect may be different at different places and may be adapted to the respective amount of light or light intensity of the light occurring there.

Another light homogenization means may be formed by a scattering panel arranged between the panel and the light source, which scatters the light passing therethrough. This means too can have a different scattering effect at different places that is adapted to the respective light intensity of the incident light there.

A further measure consists in shaping and/or structuring the reflector or its reflecting surface so that a scattering effect, in particular a desired light distribution, is achieved. This scattering or reflection effect may also be different at different places and adapted to the respective light intensity of the light that occurs there.

Within the scope of the invention the aforedescribed means or also other means according to the invention may be formed by means reducing the passage of light in such a way that the degree of reduction decreases with the distance from the lamp. In this modification the relevant means or the panel exhibits its lowest light transparency in its central region or in its region directly opposite the light source, and exhibits a greater transparency with increasing distance from the light source, whereby in its outer region or in the region of its greatest distance from the light source it may be completely or clearly transparent. As a result less light passes through the panel in the directly opposite region of the light source and more light passes through the panel with increasing distance from the light source, and correspondingly more light is also emitted at the emission surface. In this way the luminous radiation and the light pattern produced at the emission surface are homogenized in the desired way by the purposeful light distribution, and in addition light contrasts and differences in brightness are avoided or at least reduced. In this connection the radiation loss is kept low since with increasing distance from the light source the transparency and light transmission increase. Since the light transparency of the panel is least or is dampened in the region directly opposite the light source, the lamp structure or the lamp shape in the light pattern is specifically smoothed out so that it is not recognizable. Preferably the light transmission of the panel is in each case so great with respect to the distance from the light source that the light pattern or the emission produced at the emission surface, or the light intensity of the emitted light in the region of the emission opening of the light, is substantially identical.

The means according to the invention may be arranged on the panel itself or on an inner panel or film arranged between it and the light source, or alternatively may be arranged on the reflector.

The means may be partially reflecting, the amount of reflection decreasing with increasing distance from the light source. In this way a low-loss light distribution is achieved on account of the partial reflection.

The aforementioned advantages can also be achieved if the reflecting surface of the reflector comprises a scattering structure, for example in the form of grooves or grids, and/or if an opal scattering panel is arranged behind the light source in the direction of emission, viewed from the floor of the base member. By means of these measures the light rays are multiply scattered, which likewise leads to a reduction or avoidance of differences in brightness and produces an homogenization of the light pattern in the aforedescribed sense.

The modifications according to the invention are also very advantageous in combination with a base member whose edge is at least partially covered by the panel and in which the base member and the panel converge only at the edge of the panel and form a free space within the edge that permits a direct passage of light from the light source up to the edge of the panel. Such a free space may extend in a convergent or inclined manner with respect to the edge of the panel.

In particular in such lights that in their functional position are spaced from a ceiling, for example a wall-mounted light or a light suspended by suspension means, in many cases an indirect illumination of the space above the light and of the ceiling is desirable. In order to achieve this, it has already been proposed to design the light with an additional lamp that is arranged above the reflector and is provided to give indirect illumination. This measure leads to a large installation height of the light, which is undesirable if it is desired to utilize the existing vertical space as far as possible as free space. Furthermore this design leads to a complicated installation.

Another object of the invention is to modify a light so that an indirect illumination is possible also with a simpler and smaller installation height.

This object is achieved by a light constructed in accordance with an embodiment of this invention, and by advantageous developments thereof.

In the light according to this embodiment of the invention, part of the reflector is replaced by a further transparent panel that forms an acute angle with a first transparent panel. In this design the further panel replaces the reflector, and also replaces a housing wall of a light base part or light housing that may be present in the region of the reflector. In this way a laterally upwardly directed emission surface for an indirect illumination can be created, wherein the emission surface or the further panel may extend rectilinearly or in a rounded manner. It is advantageous if the further panel is arranged with the first panel in a divergent manner, whereby an emission surface that is effective for indirect illumination not only laterally but also on the upper side is produced.

The first and the further panel may in their mutually divergent position be composed of two parts or may be formed as a single part, for example by bending a suitably large panel, or may be shaped or formed by injection molding. With a one-part design as well as with a two-part design the panels may be mounted on a light source housing or may form the latter. In this connection they may be rigidly joined to two side panels so as to form a single unit, or may be mounted together with these side panels as individual parts also on the light source housing.

With lights it is customary to secure the latter with a housing frame enclosing the latter to a carrier, for example to a wall or ceiling. This arrangement is on the one hand complicated since the light has to be dismantled if work, for example maintenance work, is to be carried out on the light, apart from the removable parts of the light at its mounting point, work has to be carried out for example on the wall or ceiling. This applies also to the reassembly of the light after executing the work.

The object of the invention is also to modify a light so that its mounting on a carrier is simplified.

This object is achieved by a light constructed in accordance with another embodiment of this invention, and by developments thereof.

In the light according to this embodiment of the invention, the light is employed in a fork-like holder that is suitable for securement to a carrier such as a wall or ceiling.

This design according to the invention enables, in the case of a desired fashionable design of the light, the latter to be completely prefabricated and mounted in a simple way on the carrier so that it is used in the holder that is mounted or can be mounted on the said carrier. Accordingly, only a few procedures have to be carried out to secure the light, namely insertion of the light into the fork-like holder. This simplification also applies to the dismantling of the light as well as to work, for example maintenance work, on the light since such work does not have to be carried out at the mounting position of the light, for example using a ladder, but can be carried out in a comfortable and safe workplace after dismantling the light. In addition this design is characterized by a simple form of construction since a fork-like holder can be produced in a simpler and more cost-effective way.

BRIEF DESCRIPTION OF THE DRAWINGS

Advantageous modifications of several embodiments of the invention are described in more detail hereinafter with the aid of simplified drawings, in which:

FIG. 5 shows a cross-section of a further modified design of a light according to the invention;

FIG. 7 shows the partial section VII—VII in FIG. 5;

DETAILED DESCRIPTION OF THE PREFERRED EMBODIMENTS

Figure 1:
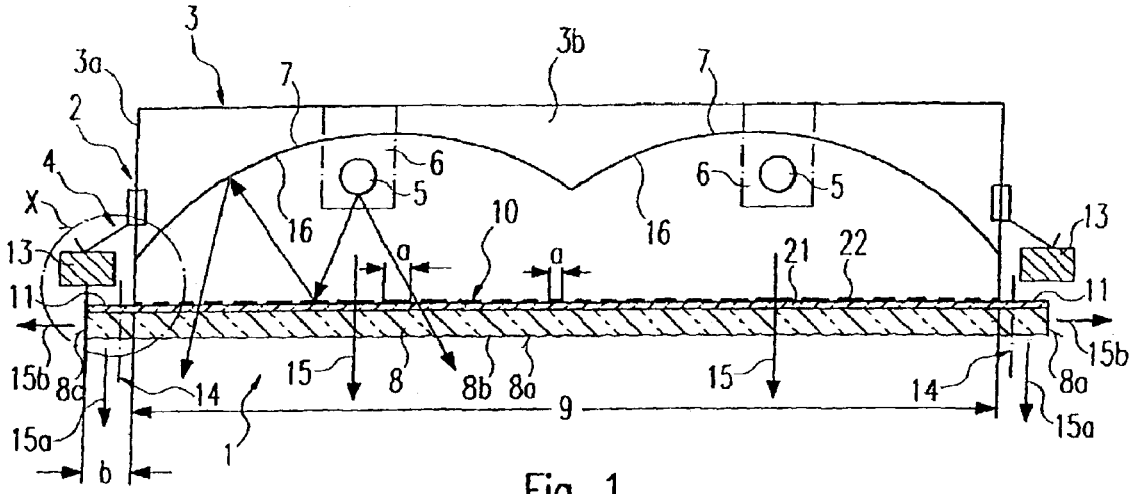
FIG. 1 shows a cross-section of a light according to the invention.

The main parts of the light identified overall by the reference numeral 1, for example in the form of a built-in light, are a base carrier 2 with a base member 3, here in the shape of a frame or an inverted trough, on which or on oppositely facing side walls 3*a* or on the perimeter are provided distributed holding elements 4 for securing the light 1 on a light carrier, which elements are mounted so that they can swivel outwardly and inwardly and are preferably also mounted in a height-adjustable manner (not shown). In addition the light 1 comprises: one or more, for example two, light sources 5 or lamps, for example gas-filled tubes, arranged here in the interior of the base member 3, which can be detachably mounted on the base member 3 by means of plug-in sockets 6, a reflector 7 for the at least one light source 5, and a panel 8, which in the present embodiment is flat or of laminar design, with an emission surface 8*a* on the broad side that is for example larger than an emission opening 9 in the base member 3 of the light 1 and thus covers not only the emission opening 9, but also edge strips 11 at least on oppositely facing edges of the base member 3.

In the present embodiment the edge strips 11 are formed by edge arms 11*a* projecting laterally from the free edges of the side walls 3*a*, the free edges of the edge arms 11*a* being able to be bent into edge arms 11*b* facing away from the panel 8, for the purposes of their stabilization. An edge region 11*c* of the base member 3 is formed in this way. The purpose of the edge strips 11 is for example to cover an installation gap in an installation opening in a ceiling 13 in which the light 1 is installed as a built-in light, wherein the edge strips 11 overlap the edge of the installation opening and rest against the underneath of the ceiling 13. The panel 8 is held in place on the base member 3 by one or more laterally arranged detachable retaining devices 14.

During operation of the light 1 equipped with conventional operating means such as for example a ballast and connection elements for at least one light source 5 of the lamp, the light generated by the light source(s) 5 is emitted through the emission opening 9 and from the emission surface 8*a* into the space to be illuminated. In order to illustrate this emitted light, a resulting main light beam is in each case represented as an arrow and identified by the reference numeral 15.

The light 1 and its emission opening 9 or its panel 8 may be oblong in shape, for example rectangular or square. The shape may also be rectangular and oblong, the side walls 3*a* and/or the edge strips 11 being arranged on the long sides. Oppositely facing side walls 3*b* that are joined to the side walls 3*a* and form the already mentioned trough may also be present on for example the narrower front sides. In such a case the light 1 is an individual light, wherein the edge strips 11 are also arranged on the two remaining sides, here the narrower transverse sides, i.e. are arranged peripherally.

The design shown in FIG. 1 may however also comprise a row of lights consisting of a plurality of lights 1 arranged after one another, a light 1 with an end-side, transversely running side wall 3*b* being arranged in each case at the ends of the row, while the lights 1 arranged between the end-side lights 1 have groove-shaped base members 3 or troughs without transversely running side walls 3*b*. In such a design the panels 8 arranged behind one another along the row of lights may rest against one another at associated gaps (not shown). The respective base carriers 2 and reflectors 7 may also rest against one another at the respective gaps. The installation opening should be designed to be suitably long having regard to the number of lights 1 arranged after one another. A tubular lamp is particularly suitable for such a design or for an individual light, the light 1 also being able to have a longitudinally extended structural shape.

The reflector or reflectors 7 consist in a known manner of two oppositely facing and—viewed in the longitudinal direction of the light 1—concavely rounded reflecting walls 16 or of a tunnel-shaped reflecting wall 16, which in the present embodiment form for example a so-called double light or multiple light, in which the light source 5 and the reflector 7 are double or multiple. The respective reflector 7 or a common reflector 7 for several light sources 5 is secured, preferably in a detachable manner, to the base member 3, as is customary, for example by means of catch devices (not shown), which permit a user-friendly and quick installation and dismantling via the emission opening 9.

The panel 8 consists of transparent material, for example plastics or glass. In this connection the panel 8 may be completely transparent or partially transparent, or opal. The panel 8 may have a structure 8*b*, in particular a microstructure, preferably a microprism structure, extending transversely to the main direction of emission 15, for example arranged on its outer emission surfaces 8*a*, or on its inner, light-receiving surface, whereby glare from the light 1 is suppressed and the light pattern at the emission surface 8*a* has less contrast and becomes more brilliant. The structure 8*b* may be a preferably regular two-dimensional structure and may be formed for example by tooth-shaped or pyramidal protuberances that may be arranged, preferably in a profiled manner, in rows running transverse to one another. Such a structure 8*b* ensures a glare suppression since the light is emitted only within a restricted angular range. An observer viewing from the side is not subjected to glare. The emission surface 8*a* may for example also be rough or matte. The emission surface 8*a* may however also be smooth. The microprism structure 8*b* may be arranged on the outside or inside of the panel 8.

The flat or laminar panel 8 is also able to act as a light guide so that the light passes not only transversely through the panel 8, but in the panel 8 itself is also guided transversely to the main direction of emission 15 into the edge regions covering the edge strips 11, with the result that the light is also emitted from the emission surface 8*a* in these regions. The dark edge regions of the light 1 that exist in the prior art are thereby also avoided or at least reduced.

Alternatively the panel 8 may be produced from opal white material, preferably pearl diffusing material, in particular from PMMA.

Furthermore the panel 8 may also serve to illuminate the surrounding peripheral region, for example the surrounding ceiling region in the case of a ceiling light. This is made possible by the fact that the panel 8 also has on its perimeter or its perimeter surface an emission surface 8*c* at which light is emitted and contributes to the brightness of the surroundings of the panel 8 or of the light 1. The light rays emitted in the regions covering the edge strips 11 and the light rays emitted in the perimeter region are identified by 15*a*, 15*b*.

The ability of the panel 8 to guide the light transversely to the main direction of emission 15 increases with increasing thickness of the panel 8. It has been found in tests that a ratio of the thickness a of the panel 8 to the width b of the covered edge or edge strips 11 of about 1:3 to 1:1, preferably about 1:2, is suitable. With a width b of about 12 mm the resulting thickness a of the panel 8 is about 4 to 12 mm, in particular about 6 mm.

The panel 8 preferably consists of a clear plastics material, in particular transparent PMMA, the panel having microprisms at least on its emission surface 8*a*. These microprisms are optimized in terms of lighting technology and are formed by steep inclined surfaces known per se of for example pyramids or studs, the inclined surfaces forming an obtuse angle W of preferably about 116.5°. This ensures that the light glare is suppressed according to the lighting standard (1000 cd/m2 under acute angles larger than 65° relative to the mid-axis or direction of emission 15). Below this value the light should emit ca. 4000 cd/m2. The tips of the pyramids are spaced from one another.

Such a panel 8 may for example be about 3 mm to about 8 mm thick. The panel behaves in a highly efficient manner on account of its thickness, especially in a transparent modification.

Particularly in the case of a structured emission surface 8*a* reflected light beams 15*b* emerge at the lateral emission surfaces 8*c*, which are aligned transverse to the direction of emission 15 or inclined to the side remote from the direction of emission 15. This is particularly favorable for making the surroundings brighter, especially with lights that are installed in or on the ceiling.

The light 1 comprises light homogenization means 10 in the region of the light path between the light source 5 and the microstructure 8*b*. By means of the means 10 the light coming directly from the at least one light source 5 and/or reflected by the at least one reflector 7 can be influenced in such a way that, during operation of the light 1, the light intensity of the light incident on the panel and thus also of the light emitted at the emission surface 8*a* is substantially equal. The means 10 may also be provided by means reducing the passage of light in such a way that the degree of reduction decreases with the distance from the light source 5. Differences in brightness and light intensity differences or contrasts in the region of the emission surface 8*a* are thus avoided or at least reduced in the functional operation of the light 1. This is desirable in order on the one hand to improve the illumination of the space, and on the other hand to avoid or to reduce visually recognizable light differences at the emission surface, and thereby also to improve the appearance of the light.

The means 10 may also be mounted on an inner panel arranged between the light source 5 and the panel 8.

In the embodiment according to FIG. 1 a film 21 or an inner panel is arranged between the light source 5 and the panel 8, preferably resting on or against the panel 8, and is held for example on the panel 8 or on the base member 3 that comprise the means 10. The light homogenization may also be achieved in each case if the film 21 or the panel is partially transparent in the region of the shortest distance to the light source 5, this transparency increasing with increasing distance from the light source 5. The film 21 or the inner panel may for example be opal or matted.

The means 10 may also be formed by providing the panel 8 or the film 21 with a grid or a layer or a covering 22 that homogenizes the light intensity of the light reaching the panel 8 or exhibits a degree of light reduction that decreases with the distance from the light source. The layer or the covering 22 or the grid may for example be imprinted. If the layer or the covering 22 is formed as a grid, the light distribution may be achieved if the grid width a decreases with increasing distance from the light source 5 or the distances between the grid increase.

Preferably the layer or the covering 22, or the grid, are partially reflecting, wherein the degree of partial deflection decreases with increasing distance from the light source 5 and may preferably become zero.

Figure 2:
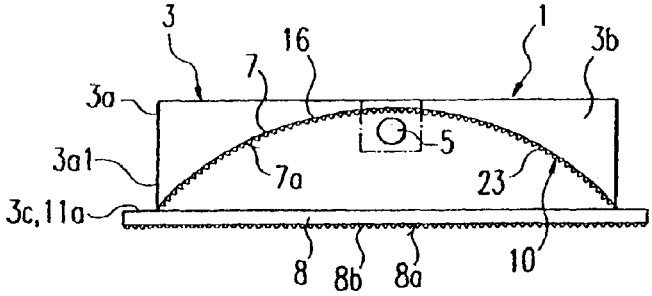
FIG. 2 shows a cross-section of a modified design of a light according to the invention.

In the embodiment according to FIG. 2, in which identical or comparable parts are provided with the same reference numerals, the reflecting surface 7*a* of the reflector 7 comprises the means 10, namely a scattering structure 23, for example behind the light source 5. In this design the light rays reflected at the reflecting surface 7*a* are scattered. This leads to a smoothing out of the light profile in the light pattern and thus to the desired homogenization of the light pattern. The means 10 may also be realized by a shaping and/or by a different degree of reflection at different parts of the reflecting surface (7*a*) such that the light intensity of the light reaching the panel 8 is substantially the same. The reflecting surface of the grid may also be formed in a corresponding way.

Figure 3:
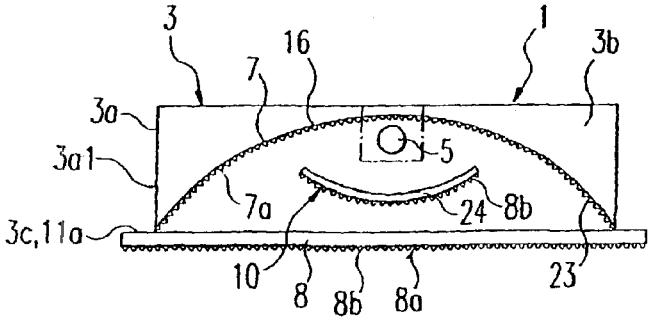
FIG. 3 shows a cross-section of a further modified design of a light according to the invention.

In the embodiment according to FIG. 3, in which identical or comparable parts are also provided with the same reference numerals, a flat or preferably curved inner panel 24 forming the means 10 is formed as a light-scattering panel between the light source 5 and the panel 8, and scatters the light rays. The light-scattering panel 24 may be opal and/or may comprise the already described microstructure 8*a*, in particular the pyramidal structure, on its side facing the panel 8. If the microstructure 8*b* is present, the light-scattering panel 24 may be transparent.

The modifications according to the invention are in each case suitable in isolation as well as in combination for improving, in the sense of a light homogenization, the light pattern produced at the emission surface 8*a* during functional operation.

The panel 8 may also be formed as a diffuser panel and may be matte or opal. This means that it contains very small particles that scatter the light. The diffuser panel therefore scatters incident light rays from the lamp in all directions. An observer standing outside the incident illumination region of the light thus has the visual impression of scattered light. This is desirable insofar as the diffuser panel ensures a largely uniform light emission.

The combination of a panel 8 formed as a diffuser panel with a light-scattering panel 24 having the microstructure 8*b* reduces the brilliance of the light pattern, which may be desirable.

An enhanced brilliance is obtained if the panel 8, preferably structured with pyramids, is combined with a grid or a light-scattering structure 23 at the reflecting surface 7*a* or if this panel 8 is combined with the light-scattering panel 24, for example omitting the formation of the panel 8 as a diffuser panel, wherein the panel 8 may for example be transparent.

The aforedescribed means 10 according to the invention for the light distribution may be formed in addition or only on the light-scattering panel 24, which latter may then be appropriately made for example opal and/or coated and/or covered and/or provided with a grid.

The designs according to the invention are ideally suitable for a so-called light field, in which several lights 1 are arranged in cascade formation in one or more rows running adjacent or crosswise to one another.

All embodiments may involve lights that are designed as a built-in light or as a mountable light.

The designs according to the invention are preferably suitable for a flat light with a flat dome-shaped reflector 7. In a flat light the distance between the light source 5 and the panel 8 is particularly small and accordingly the differences in the light intensity of the light emitted from the panel 8 and the differences in brightness during operation are particularly large, and the problem of a varying light pattern thus becomes particularly important.

The invention enables a light 1 with an installation height of about 50 mm to be realized, the desired light properties thereby being achieved. For such a low installation height it is advantageous to use for the at least one light source 5 fluorescent lamps of 16 mm diameter, which preferably extend rectilinearly.

Figure 4:
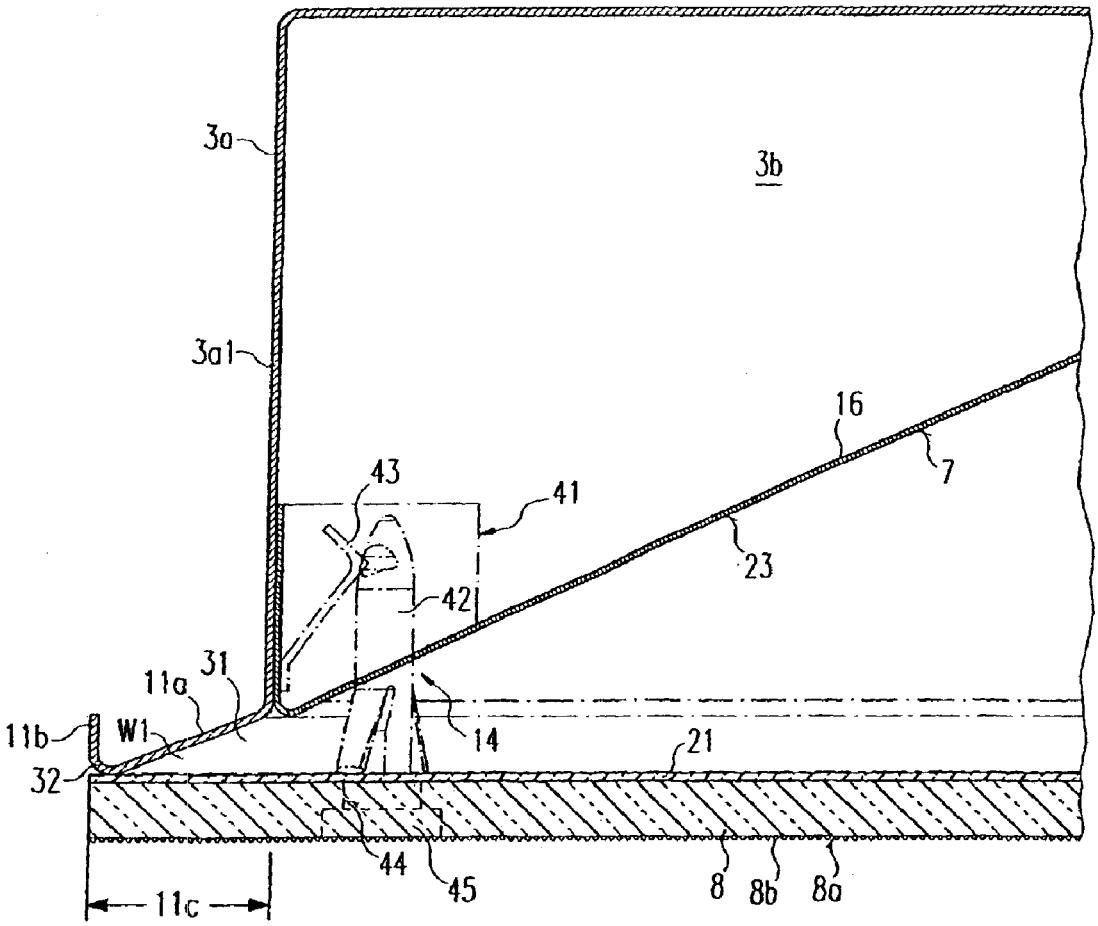
FIG. 4 shows the detail identified by X in FIG. 1, and in corresponding positions in FIGS. 2 and 3 in a light in a further modified design.
Figure 6:
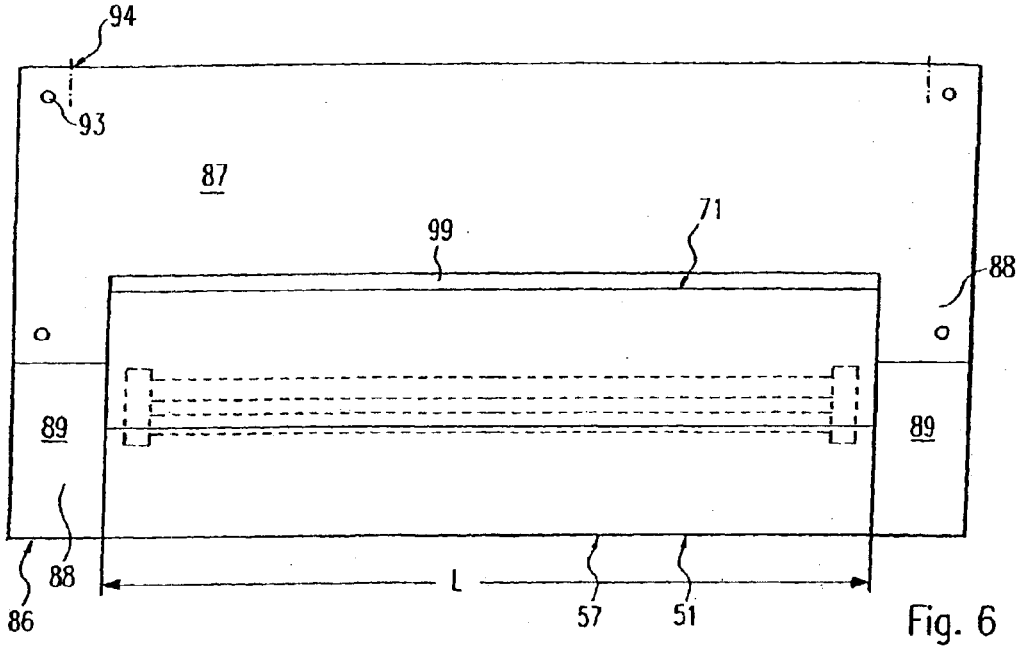
FIG. 6 is a plan view of the light according to FIG. 5.

The designs according to the invention are also suitable in an extremely advantageous manner for the embodiment according to FIG. 4, in which a free space 31 is arranged between the edge region 11*c* and the inside of the panel 8, which free space extends up to a bearing surface part 32 arranged on the edge of the panel 8 and that is part of the carrying member 3. The free space 31 is preferably formed so as to converge towards the edge. In the embodiment it is bounded by the inside of the panel 8 and by the outer surface, facing towards it and preferably flat, of an edge arm 11*a*. The boundary surfaces form an acute angle W1 of about 15° to about 30°, preferably about 23°. As already explained in the aforedescribed embodiment, the edge arm 11*a* and the preferably also present edge arm 11*b* may be joined as one part to a side wall arm 3*a*1 forming the associated side wall 3*a*, for example may be bent away from it.

On account of the presence of the free spaces 31 that laterally face one another or are present over the whole perimeter, the light emitted by the light source or lamp 5 or reflected from the oppositely facing reflecting wall 16 can penetrate directly substantially up to the edge of the panel 8 into the latter, whereby the external and/or lateral emission in the region of the auxiliary light rays 15*a* and 15*b* is improved and intensified. In this way light is increasingly emitted in the region of the edge of the panel 8 and accordingly the surroundings are increasingly illuminated, whereby the contrast of the light 1 or panel 8 with respect to the surroundings and to the central region of the panel 8 is reduced.

Within the scope of the invention one or more retaining devices 14 may be arranged on oppositely facing sides of the light 1 inside the edge region 11*c*, as shown in FIG. 4. In this design the retaining elements associated with the base member 3 may preferably be detachably secured to the inside of the base member. In the embodiment according to FIG. 4 the at least one retaining device 14 is formed by a catch device 41 with a catch pin 42 that can be engaged by a movement away from the side facing the space to be illuminated together with at least one catch element 43 arranged on the base member 3. On account of at least one spring-elastically effective catch element, this catch device 41 is formed in such a way that when the catch pin 42 is inserted the catch element 43 automatically gives way and snaps into place. To release the catch pin the catch device 41 can be overridden by a manual tractive force on the catch pin 42, i.e. by exerting a manually applicable tractive force on the catch pin 42 the catch element or elements 43 automatically give way, with the result that the locking action is released and the panel 8 can be removed from the base member 3. The panel 8 can be installed by a user-friendly insertion of the at least one catch pin 42, the at least one catch element 43 automatically giving way and engaging with the catch pin 42. The catch pin 42 protruding internally from the panel 8 preferably consists of transparent material and can engage the panel 8 in a hole 44. A pinhead 45 that is optionally present engages in a countersunk hole 44.

At least one small air gap should be arranged between the inner panel or film 21 and the panel 8 in order not to interfere with the light-conducting function of the panel 8. The air gap is provided by an abutment surface or bearing surface of the internal additional panel or film 21.

In the embodiment according to FIGS. 5 to 8 the light identified overall by the reference numeral 51 is likewise aligned towards the light emission in a main direction of emission 52 in a first emission zone, which in the situation according to FIG. 5 is aligned vertically downwards. Also, in a lateral region B the light 51 is aligned upwardly for a light emission in order to illuminate the space over this lateral region B or the ceiling space in the manner of an indirect illumination. To this end the light 51 comprises a preferably flat first transparent panel 54 that is pre-arranged roughly in the center and transverse to the main direction of emission 52 of a light source 55. In addition the light 51 comprises a preferably also flat second transparent panel 56 that extends in the lateral region B, likewise transverse to the main direction of emission 52, but spaced laterally with respect to the latter.

The panels 54, 56 are walls of a light source housing 57, which according to FIG. 5 is in the shape of a tunnel or dome, wherein the lateral region B is arranged with respect to the main direction of emission 52 on one side, in FIG. 5 for example on the left-hand side of the light 51 or of the light source housing 57, and forms a ceiling wall section 58 of the tunnel-shaped or dome-shaped light source housing 57. The ceiling wall section facing the axis of the main direction of emission 52 is identified by the reference numeral 59 and is formed by a reflector 61 that extends from the central ridge region behind the light source 55 laterally as far as the edge region of the light source housing 57 on this side. In the embodiment the ceiling wall sections 58, 59 extend upwardly in a convergent manner from the oppositely facing lower side edges 62, 63, and coincide in the ridge region, the tunnel-shaped or dome-shaped contour thereby being formed. The reflector 61 is as regards its reflecting surface 61*a* curved concavely at least in the ridge region or over its whole width. The curvature may be progressive up to the ridge region in order to reflect the light rays emitted from the light source 55 into the main direction of emission, the resultant direction being identified by the arrow 52. In the embodiment the ceiling wall sections 58, 59 extend substantially from the lateral edges 62, 63 of an associated floor wall section of the light source housing 57, which is formed by the first panel 54. The light source housing 57 thus has a substantially triangular cross-sectional shape, whose corner remote from the main direction of emission 52 may be rounded in the ridge region.

In the embodiment the second panel 56 extends over the whole lateral region B, in which connection it may start from the associated side edge 62 and extend up to the facing edge of the reflector 61. The external edges of the panels 54, 56 may be tightly connected at the side edge 62 to a side wall section (not shown) of the light source housing 57. In the case of the substantially triangular shape of the light source housing 57 the panels 54, 56 extend as far as the common corner region, where they may tightly abut one another or are joined to one another, so that they are formed by a prefabricatable one-piece panel structural part.

In the embodiment the second panel 56 arranged divergently with respect to the first panel 54 forms an acute angle W2 with the said first panel 54, which may for example be about 15° to 60° and is preferably about 20°. The panels 54, 56 may in the region of the side edge 62 directly start from one another or may be joined to one another by a rounded or straight panel section 64. The one-piece panel structural part may be directly formed in this shape, for example by injection molding or by bending about a common bending line (not shown), or may be bent about two bending lines 65*a*, 65*b* arranged above one another, for example in the heated state at least in the region of the at least one bending line. On the oppositely facing side edge 63 the reflector 61 extends preferably as far as the associated edge of the first panel 54. The light source housing 57 described so far may be closed by side walls 66, shown in FIG. 7, on the two remaining oppositely facing sides, which in the embodiment extend from the first panel 54 in the cross-sectional shape of the light source housing 57 as far as the second panel 56 and up to the reflector 61, and may be securely joined to the panels 54, 55, for example by a plug-in connection or by bonding or welding. The side walls 66 may consist of transparent or opaque material, and in the first case may thus be involved in a lateral light emission.

Mechanical and electrical connection means for the light source 55 are arranged in the light source housing 57, and preferably comprise a gas discharge lamp, preferably in the form of one or two tubes. The one or two connection means arranged in oppositely facing end regions of the light source housing 57 may be formed by a conventional plug-in socket whose socket bodies 67 are arranged in the ridge region and are secured internally on the light source housing 57. In the embodiment two electrical connection means are arranged adjacent to one another for two tubular gas discharge lamps 68, in each case on a common socket body 67. The light source housing 57 is preferably designed lengthwise in the longitudinal direction of the gas discharge lamps 68 so that the width B1 shown in FIG. 5 is less than the length L of the light source housing 57 shown in FIG. 6.

The light source housing 57 is rigidly or detachably connected to a base carrier 71, by means of which or with which it can be positioned jointly on a holding device in the existing space. The base carrier 71 is preferably arranged substantially in the spatial region above the reflector 61, wherein the cross-sectional shape of the base carrier 71 extends from the side edge 63 as far as the apex region, preferably up to the second panel 56, and expands the associated section of the light source housing 57, in the present case roughly into the right-hand half of the light source housing 57, to form a rectangularly shaped structural body. The base carrier 71 is preferably a hollow box with a side wall 73 extending upwardly from its side edge 63, from the upper edge of which side wall there preferably extends in one piece a ceiling wall 74 as far as the apex region, preferably up to the second panel 56. In order to stabilize this edge of the ceiling wall 74 an upwardly extending arm 75 may be arranged on the edge, and is preferably bent upwardly. In order to prevent the arm 75 protruding beyond the upper side, the ceiling wall 74 in the relevant edge region b may be bent downwardly so that the arm 75 terminates roughly with the upper side of the second panel 56. The edge region of the reflector 61 facing the second panel 56 is connected, preferably detachably, to the for example downwardly bent ceiling wall 74, and can be screwed in from the inside or outside in a space-saving manner by for example a cap screw 76 engaging both parts in matching holes, for example a so-called self-tapping screw. The light source housing 57 is stabilized by the abutment of this edge region of the reflector 61 on the ceiling wall 47. In addition, in the ridge region the reflector 61 may be supported via its inside on a stepped surface 77 of the socket member 67 arranged in a mirror-image manner. The opposite side edge of the reflector 61 is detachably secured to the side wall 73 of the base carrier 71. On this side edge the reflector 61 may comprise an upwardly bent arm 78 that may serve for the abutment or securement to the side wall 73. This side edge of the reflector 61 is preferably positioned on the base carrier 71 or on its side wall 73 by means of a plug-in socket 79.

Electrical connection and/or operating components for the light 51 may be arranged in the free space 81 above the reflector 61, for example an electrical ballast 82 that is joined or can be joined to a power supply cable, which may pass through a passage in the side wall 73 or ceiling wall 74 and is connected to at least one further connection cable (not shown) together with the at least one connection element 67*a* of the socket.

Figure 8:
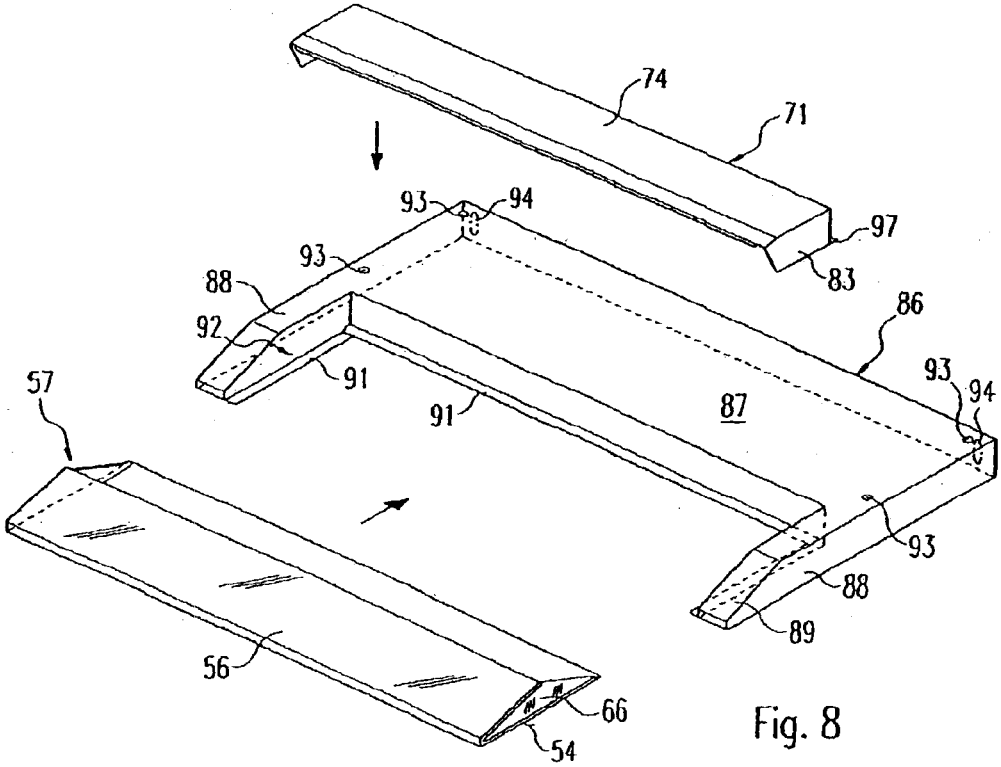
FIG. 8 is a perspective view of the light according to FIG. 5 showing the structural parts in exploded form.

As can be seen from FIGS. 7 and 8, the base carrier 71 may comprise two further side walls 83 extending from the side wall 73 and the ceiling wall 74 up to the ridge region, which contribute to the stabilization and laterally overlap the latter in its position connected to the light source housing 57.

In order to connect the light source housing 57 to the base carrier 71, a releasable connection is provided, preferably in the form of a plug-in socket 84, into which the light source housing 57 can be inserted by means of a substantially horizontal movement, and which can be prevented by securement means, preferably by clamps, from coming loose. The plug-in socket 84 may co-operate with the panels 54, 56. U-shaped clamping elements 85, whose arms are clamping arms that engage the panels 54, 56 with a clamping force, are preferably arranged on the lower edge facing the first panel 54 and on the upper edge of the base carrier 71 facing the second panel. The clamping arms preferably comprise at their free edges convergent rounded or inclined insertion surfaces that facilitate the insertion of the panels 54, 56, wherein the clamping arms are elastically splayed and press against the broad sides of the panels 54, 56 in a clamping manner. The clamping elements 85 may be secured to the edges of the base carrier 71 in the form of U-shaped bars or in the form of a plurality of clamping pieces arranged in a distributed manner.

The plug-in socket 79 may be formed by the gusset-shaped free space between the side wall 73 and the facing arm of the clamping element 85. The lower edge of the reflector 61 is positioned in an interlocking manner in this free space, having regard to the rigidity of the reflector 61.

A fork-like holder 86 with a holder base 87 and holding arms 88 protruding horizontally therefrom, whose length corresponds to the width B1 of the light 51, is provided for the positioning of the light 51 formed by the light source housing 57 and the base carrier 71 in the space to be illuminated, so that the free space existing between the holder arms 88 roughly corresponds to the corresponding size of the light 51. The holder arms 88 may in their free end regions be matched on the upper side to the shape of the light source housing 57, for example may be suitably rounded or inclined. The relevant inclined surfaces are identified by 89. To retain the light 51 on the holder base 87, carrying elements 91 are arranged at least on the mutually facing sides of the holder arms 88 or also on the facing side of the holder base 87. In the embodiment the carrying arms 91 are arranged on the lower edge of these parts, and may be formed by protruding carrying arms, which for example are formed continuously on the associated edge of the parts carrying them. A plug-in socket 92 is thereby formed, into which the light 51 from a region can be inserted horizontally to vertically. At least one securement element (not shown) is provided in order to secure the light 51 in the plug-in socket 92.

In the embodiment the light 51 and the holder 86 are capable of being mounted on a support (not shown), for example a wall of a room, or are capable of being mounted on a ceiling in the suspended position. One or more brackets or pendants may serve for this purpose, which are connected or can be connected at one end to a securement element for mounting on the ceiling and at the other end to the holder 86, for which purpose connecting elements 93 may be arranged on the holder 86, in this case on the upper side of the holder base 87. For a lateral securement, securement elements 94 may be arranged on the rear side of the holder base 87, for example for fastening screws for screwing into the support, which may be accessed by lateral recesses (not shown) in the holder base 87.

The holder base 87 and preferably also the holder arms 88 may be box-shaped hollow bodies and may consist for example of sheet metal. The holder base 87 may be a so-called ceiling sail that projects from an air-conditioning unit (not shown), wherein heating and cooling ribs (not shown) through which liquid flows extend along the holder base 87.

The first panel 54 may correspond as regards its design and function to the panel 8 of the aforedescribed embodiments. It may for example include on its lower side or upper side a microstructure 8*b* to suppress glare. Aforedescribed light homogenization means 10 may also be provided.

In the embodiment the panels 54, 56, 66 consist of transparent material, for example glass or plastics, in particular PMMA. A panel 8 that is for example microstructured, in particular microprism-structured, on the underneath or upper side is arranged on the first panel 54, the length of the panel 8 corresponding to the length L of the first panel 54 and its width being such that, when resting on the first panel 54, it extends from the side edge 63 as far as the opposite edge 62 or extends into the region of the hollow valley of the one-part panel body. A light homogenization means 10 is arranged in the region of the light path between the light source 55 and the panel 8, which means may be formed for example as a film 21 and may rest on the panel 8.

A second inner panel 95 may be arranged interiorly of the second panel 56, which scatters the light exiting to provide indirect illumination, whose resultant direction of emission is shown by the inclined, upwardly extending arrow 96 in a second emission zone. This may be an opal panel or one from which the light exits in a diffuse manner. A diffuser-pearl panel 95 is provided in the embodiment. The thickness of the panels 54, 56, 66, 95 may for example be about 3 mm. The thickness of the panel 8 may correspond to that of the aforedescribed embodiments.

In the last described embodiment, with panels 54, 94 and 56, 95 lying adjacent to or abutting one another, the clamping elements 85 are sufficiently large so that their arms overlap the present panels in the aforedescribed way.

In the embodiment a web 97 projects outwardly from the lower edge of the side wall 73, the free edge of the web being able to be stabilized by an upwardly bent arm 98. The web 97 and the arm 98 rest on the adjacent edge of the holder base 87. An installation gap 99 between the base carrier 71 and the light 51 and the holder 86 is thereby formed, in which the power supply cable can run.

What is claimed is:

1. A light, comprising:

a light source or connection means therefor;

a transparent panel extending transversely to a direction of light emission, provided with a microstructure shaped to direct light in a single direction; and a reflector that comprises reflecting surfaces, wherein light homogenization means are provided that ensure that a light intensity of light entering the transparent panel is roughly equal in all parts of the transparent panel, and wherein the light homogenization means are formed by an opal inner panel or an opal inner film arranged between the light source and the transparent panel and resting in an inside on or against the transparent panel, and wherein the light homogenization means are furthermore formed by a covering or layer or a grid, wherein the grid is reflecting or partially reflecting.

2. A light according to claim 1, wherein the inner panel or the film has a varying light transmission depending on a distance to the light source.

3. A light according to claim 1, wherein the grid or the covering or the layer is imprinted by silk screen printing or ink printing.

4. A light according to claim 1, wherein the light homogenization means are furthermore formed by at least one of a corresponding shaping of the reflecting surface and a different degree of reflection at different parts of the reflecting surface.

5. A light according to claim 4, wherein a scattering structure of the reflecting surface is formed by grooves or grids.

6. A light according to claim 1, wherein a base member and the transparent panel coincide only at an edge of the transparent panel and form a free space within the edge, which permits a direct transmission of light from the light source up to the edge of the transparent panel.

7. A light according to claim 6, wherein an edge surface of an edge region opposite the transparent panel extends in a converging, inclined manner up to the edge of the transparent panel.

8. A light according to claim 7, wherein a wall of a reflector ends at an inner edge of the edge region, at least one reflecting surface of the reflector being substantially aligned with the surface of the edge region facing the transparent panel.

9. A light according to claim 7, wherein the edge region is formed by an edge arm that originates at an obtuse angle from a side wall arm of the base member.

10. A light comprising:

a light source or connection means therefor;

a reflector;

a first transparent panel extending transversely to a direction of light emission, which forms a first light emission zone; and a second transparent panel arranged divergently with respect to said first transparent panel, wherein said first and second panels extend from a common corner region.

11. A light according to claim 10, wherein the second, further transparent panel is arranged on one side of the light and is connected in a U-shaped or V-shaped manner in one piece with the first transparent panel.

12. A light comprising:

a light source or connection means therefor;

a reflector; and a first transparent panel extending transversely to a direction of light emission, which forms a first light emission zone wherein a region of the reflector comprises a second, further transparent panel that forms a further light emission zone, wherein the reflector extends in a flat dome-shaped manner, from an edge region facing it of the second, further transparent panel to a latter oppositely facing side edge region of the first, transparent panel.

13. A light according to claim 12, wherein a base carrier is provided for the panels, which extends substantially at least over the reflector.

14. A light according to claim 13, wherein the base carrier comprises plug-in sockets for holding the panels.

15. A light according to claim 14, wherein the plug-in sockets are formed by elements of U-shaped cross-section into which the panels can be inserted and in which the panels are secured, by a clamping pressure of arms of elements overlapping the panels.

16. A light according to claim 10, wherein the first, transparent panel comprises a microstructure, in particular a microprism structure, on its outside or inside, or a panel which comprises a microstructure, in particular a microprism structure, on its outside or inside is arranged interiorly or exteriorly of the first, transparent panel.

17. A light comprising a light source or connection means therefor, and a transparent panel extending transversely to a direction of light emission, wherein the light is employed in a fork-like holder that is suitable for securement to a wall or ceiling.

18. A light according to claim 17, wherein the fork-like holder is formed by a holder base with holder arms protruding therefrom.

19. A light according to claim 18, wherein free space between the holder arms corresponds substantially to a size and shape of the light.

20. A light according to claim 18, wherein inwardly protruding carrying elements for the light are arranged on inner lower edges of the holder arms, which are formed by strips extending along edges.

* * * * *